US009448525B2

(12) United States Patent
Tsutsumi

(10) Patent No.: US 9,448,525 B2
(45) Date of Patent: Sep. 20, 2016

(54) IMAGE FORMING APPARATUS HAVING FIRST CHARGING DEVICE PERFORMING SUPPLEMENTARY CHARGING PROCESS AND SECOND CHARGING DEVICE PERFORMING MAIN CHARGING PROCESS

(71) Applicant: KYOCERA Document Solutions Inc., Osaka-shi (JP)

(72) Inventor: Masahiro Tsutsumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/801,765

(22) Filed: Jul. 16, 2015

(65) Prior Publication Data

US 2016/0026110 A1 Jan. 28, 2016

(30) Foreign Application Priority Data

Jul. 23, 2014 (JP) ..... 2014-149846

(51) Int. Cl.
*G03G 15/02* (2006.01)
*G03G 21/00* (2006.01)
*G03G 21/06* (2006.01)

(52) U.S. Cl.
CPC ..... *G03G 21/06* (2013.01)

(58) Field of Classification Search
CPC ..... G03G 15/0266; G03G 21/08; G03G 15/043; G03G 21/06; G03G 15/047
USPC ..... 399/32, 50, 128
See application file for complete search history.

(56) References Cited

U.S. PATENT DOCUMENTS 5,568,232 A * 10/1996 Kashihara ..... G03G 15/0225 399/143
5,659,839 A * 8/1997 Mizude ..... G03G 15/0266 399/50
6,332,064 B1 * 12/2001 Sato ..... G03G 15/0216 399/128
6,415,122 B1 * 7/2002 Hara ..... G03G 15/201 399/128
2003/0016961 A1 * 1/2003 Kitajima ..... G03G 15/0266 399/50

FOREIGN PATENT DOCUMENTS

JP H07-043988 A 2/1995

* cited by examiner

*Primary Examiner* — Francis Gray
(74) *Attorney, Agent, or Firm* — Studebaker & Brackett PC

(57) ABSTRACT

An image forming apparatus includes an image bearing member, a transfer device, a first charging device, a static elimination device, a second charging device, a light exposure device, and a development device. The transfer device transfers a developer image of a first polarity onto a recording medium from the image bearing member by receiving a transfer bias of a second polarity. The first charging device charges a region of the image bearing member that has undergone transfer to the first polarity by receiving a first charging bias of the first polarity. An absolute value of the first charging bias is greater during charging of a first region of the image bearing member than during charging of a second region of the image bearing member. The first region includes a trailing end contact section. The second region does not include the trailing end contact section or a leading end contact section.

6 Claims, 5 Drawing Sheets

IMAGE FORMING APPARATUS HAVING FIRST CHARGING DEVICE PERFORMING SUPPLEMENTARY CHARGING PROCESS AND SECOND CHARGING DEVICE PERFORMING MAIN CHARGING PROCESS

INCORPORATION BY REFERENCE

The present application claims priority under 35 U.S.C. §119 to Japanese Patent Application No. 2014-149846, filed on Jul. 23, 2014. The contents of this application are incorporated herein by reference in their entirety.

BACKGROUND

The present disclosure relates to image forming apparatuses.

Image forming apparatuses that use electrophotography are commonly known.

An electrophotographic image forming apparatus typically forms an image on paper by performing processes such as charging, light exposure, development, and transfer.

In a more specific example, an image bearing surface is uniformly charged to a specific electrical potential of a first polarity (for example, positive polarity) in a charging process. The image bearing surface is an outer circumferential surface of a photosensitive drum that acts as an image bearing member. Note that in the following explanation, the first polarity is positive polarity. Next, the image bearing surface is exposed to light in a light exposure process so as to form an electrostatic latent image on the image bearing surface. After the light exposure process, the electrostatic latent image on the image bearing surface is developed in a development process using charged toner. A toner image is formed on the image bearing surface through the development process. In a situation in which development is performed by reversal development, toner charged to the same polarity (first polarity) as the image bearing surface is used.

After the development process, a transfer bias of a second polarity is supplied to a transfer roller pressed against the photosensitive drum in a transfer process. The second polarity is the opposite polarity to the first polarity. The toner image formed on the image bearing surface is transferred onto paper as the paper passes through a nip between the photosensitive drum and the transfer roller. An image is formed on the paper through the transfer process. After the transfer process, cleaning and static elimination are performed on the image bearing surface before starting a next charging process.

Electrophotographic image forming apparatuses suffer from problems such as described below. The following problem is caused by the transfer bias. Upon the transfer bias of the second polarity being supplied to the transfer roller during the transfer process, current (transfer current) flows between the photosensitive drum and the transfer roller via the nip. As a result, the electrical potential of the image bearing surface, which is charged to the first polarity, decreases. In such a situation, a greater transfer current flows in a non-toner bearing section than in a toner bearing section. The term non-toner bearing section refers to a section of the image bearing surface on which toner is not present and the term toner bearing section refers to a section of the image bearing surface on which toner is present. Therefore, the non-toner bearing section has a lower electrical potential than the toner bearing section. In other words, non-uniformity arises in the electrical potential of the image bearing surface (non-uniform electrical potential).

Furthermore, a situation may occur in which a section of the image bearing surface in which a particularly large transfer current flows becomes charged to the second polarity.

In a situation in which non-uniform electrical potential of the image bearing surface arises and a section of the image bearing surface becomes charged to the second polarity, electrical charge of the second polarity remains on the image bearing surface without being removed even if static elimination is performed in order to eliminate electrical charge of the first polarity and lower electrical potential of the image bearing surface to an initial electrical potential. Therefore, non-uniform electrical potential of the image bearing surface remains. As a consequence of the remaining non-uniform electrical potential, an image defect such as non-uniform image density may occur the next time that image formation is performed (in particular, when image formation is performed repeatedly with short intervals between repetitions).

Non-uniform electrical potential of the image bearing surface may also arise for the following reason. Electrical resistance of the nip is greater when paper is present in the nip than when paper is not present in the nip. Therefore, when an end of a sheet of paper in terms of a conveyance direction thereof (i.e., a leading end or a trailing end) passes through the nip there is a sudden change in the electrical resistance of the nip, which is accompanied by a sudden change in the transfer current. As a consequence, an end contact section of the image bearing surface exhibits a large fluctuation in electrical potential. The term end contact section refers to a section of the image bearing surface that has come into contact with the end of the sheet of paper in terms of the conveyance direction. As a result of the above, non-uniform electrical potential of the image bearing surface arises in a line-shaped pattern. For example, when a trailing end of a sheet of paper in terms of the conveyance direction passes through the nip, there is a sudden decrease in electrical resistance of the nip, which is accompanied by a sudden increase in the transfer current. As a consequence, the electrical potential of a trailing end contact section of the image bearing surface exhibits a large reduction in electrical potential. The term trailing end contact section refers to a section of the image bearing surface that has come into contact with the trailing end of the sheet of paper in terms of the conveyance direction. As a result of the above, non-uniform electrical potential of the image bearing surface arises in a line-shaped pattern. If the line-shaped non-uniform electrical potential remains on the image bearing surface, the next time image formation is performed an image defect appears as a horizontal line in a formed image.

One known example of an image forming apparatus includes a primary pre-charging device that is located downstream of a static elimination device and upstream of a primary charging device in terms of a rotation direction of an image bearing member.

SUMMARY

An image forming apparatus according to one aspect of the present disclosure includes an image bearing member, a transfer device, a first charging device, a static elimination device, a second charging device, a light exposure device, and a development device. The image bearing member bears a developer image formed using a developer charged to a first polarity. The transfer device forms a nip in conjunction with the image bearing member. The transfer device transfers the developer image onto a recording medium from the image bearing member, as the recording medium passes through the nip, by receiving a transfer bias of a second polarity opposite to the first polarity. The first charging device charges a region of the image bearing member that has undergone transfer by the transfer device to the first polarity by receiving a first charging bias of the first polarity. The static elimination device eliminates static from the region of the image bearing member that has been charged by the first charging device. The second charging device charges the region of the image bearing member from which static has been eliminated by the static elimination device to a specific electrical potential of the first polarity by receiving a second charging bias of the first polarity. The light exposure device forms an electrostatic latent image on the image bearing member by exposing the region that has been charged by the second charging device to light. The development device forms the developer image on the image bearing member by developing the electrostatic latent image using the developer. A first value corresponding to an absolute value of the first charging bias during charging of a first region of the image bearing member is greater than a second value corresponding to the absolute value of the first charging bias during charging of a second region of the image bearing member. The first region includes a section that has come into contact with a trailing end of the recording medium in terms of a conveyance direction thereof. The second region does not include the section that has come into contact with the trailing end or a section that has come into contact with a leading end of the recording medium in terms of the conveyance direction.

DETAILED DESCRIPTION

The following explains an embodiment of the present disclosure with reference to the drawings. However, the embodiment explained below does not in any way limit the disclosure according to the scope of the claims. Furthermore, not all of the elements of configuration described in the embodiment are essential for achieving the effects of the present disclosure. Note that when the same reference sign is used in more than one of the drawings, the reference sign indicates the same element in each drawing.

Figure 1:
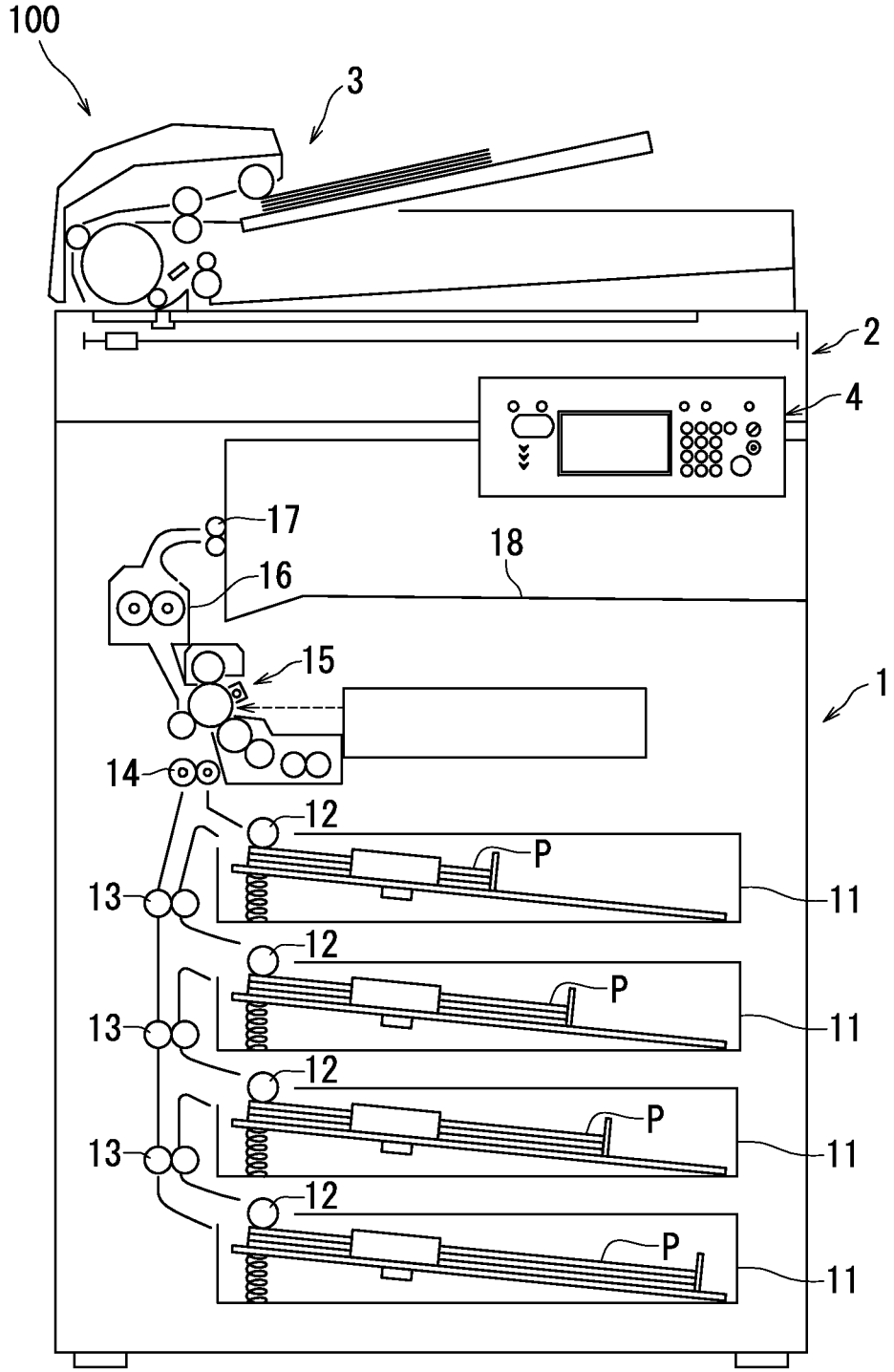
FIG. 1 illustrates configuration of an example of an image forming apparatus according to an embodiment.

FIG. 1 illustrates configuration of an example of an image forming apparatus according to the embodiment.

An image forming apparatus 100 is for example a multifunction peripheral (MFP). The image forming apparatus 100 has the functions of a scanner, a copier, a printer, and a facsimile (fax) machine. The image forming apparatus 100 includes an image forming unit 1, an image scanning unit 2, a document conveyance device 3, and an operation panel 4. The image forming unit 1 forms an image on a sheet of paper P, which is an example of a recording medium. The image scanning unit 2 scans an image of a document. The document conveyance device 3 conveys a document that is a scanning target. The operation panel 4 is a device through which the image forming apparatus 100 is operated by a user.

The image forming unit 1 includes paper feed cassettes 11, paper feed rollers 12, conveyance roller pairs 13, a registration roller pair 14, an image forming section 15, a fixing device 16, an ejection roller pair 17, and an exit tray 18. The paper feed rollers 12 pick up paper P from the paper feed cassettes 11 one sheet at a time. The paper P picked up by the paper feed rollers 12 is conveyed to the image forming section 15 by the conveyance roller pairs 13 and the registration roller pair 14.

The image forming section 15 performs an image formation process to form an image on the paper P conveyed from the paper feed cassettes 11 based on image data. The image data may for example be image data that has been generated by the image scanning unit 2 through scanning of a document or image data that has been received from an external computer via a communication network. Once an image has been formed on the paper P by the image forming section 15, the paper P is conveyed to the fixing device 16. Detailed explanation of the image forming section 15 is provided further below with reference to FIG. 2.

The fixing device 16 fixes, onto the paper P, the image that has been formed on the paper P. The fixing device 16 includes a heating roller and a pressure roller. The heating roller has an internal heating member. The heating roller and the pressure roller are pressed against one another to form a fixing nip therebetween. Toner on the surface of the paper P is heated and melted as the paper P passes through the fixing nip. As a result, a toner image is fixed onto the paper P. The paper P having the toner image fixed thereto is ejected onto the exit tray 18 by the ejection roller pair 17.

Figure 2:
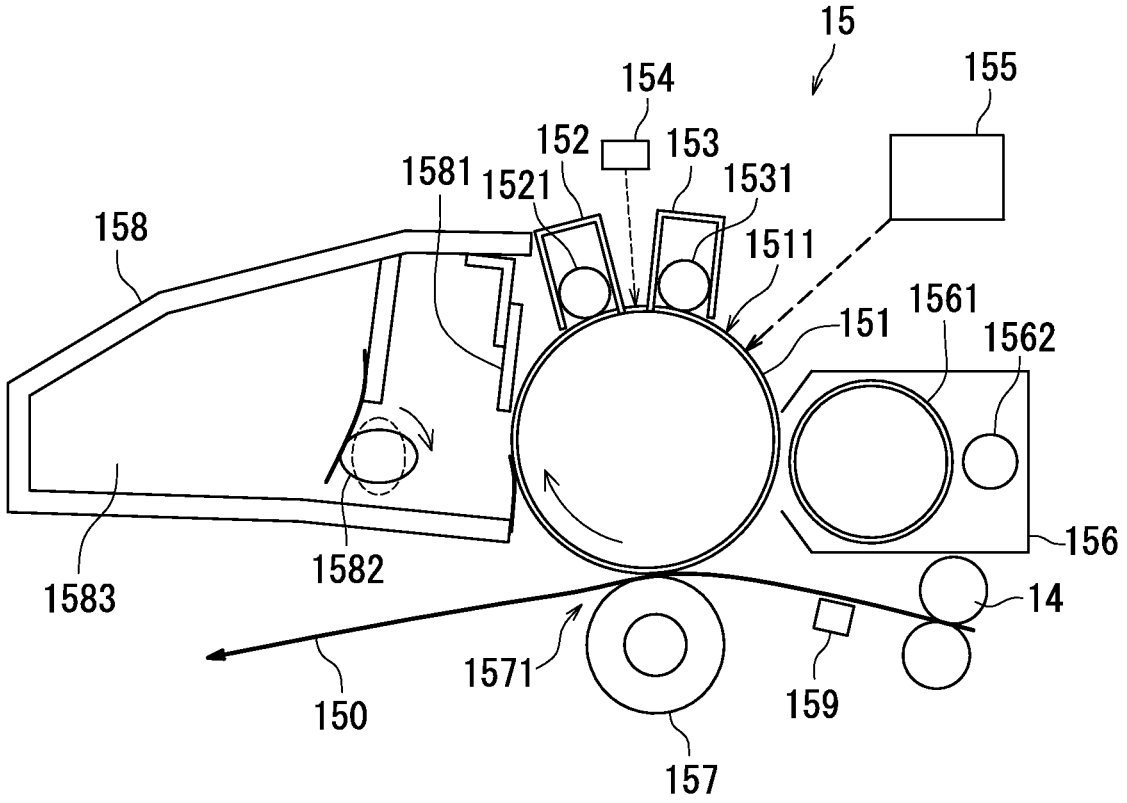
FIG. 2 illustrates configuration of an example of an image forming section according to an embodiment.

FIG. 2 illustrates configuration of an example of the image forming section according to the embodiment.

The image forming section 15 includes a photosensitive drum 151, a first charging device 152, a second charging device 153, a static elimination device 154, a light exposure device 155, a development device 156, a transfer roller 157, a cleaning device 158, and a trailing end detection switch 159.

The photosensitive drum 151 is an image bearing member. The image bearing member bears a developer image (a toner image in the present embodiment) thereon. The developer image is charged to a specific first polarity (positive polarity in the present embodiment). The photosensitive drum 151 is approximately cylindrical. An outer circumferential surface of the photosensitive drum 151 is an image bearing surface 1511 on which an electrostatic latent image and a toner image are formed. The image bearing surface 1511 is for example formed by an organic photosensitive member.

In the present embodiment, the photosensitive drum 151 rotates in a direction corresponding to clockwise in FIG. 2. The first charging device 152, the static elimination device 154, the second charging device 153, the light exposure device 155, the development device 156, the transfer roller 157, and the cleaning device 158 are arranged around the photosensitive drum 151 in the stated order in terms of the rotation direction of the photosensitive drum 151. The first charging device 152, the static elimination device 154, the second charging device 153, the light exposure device 155, the development device 156, the transfer roller 157, and the cleaning device 158 each perform a specific process on a region of the image bearing surface 1511 located opposite thereto (referred to below as an opposite region). The photosensitive drum 151 is caused to rotate. As a result of rotation of the photosensitive drum 151, a given region of the image bearing surface 1511 becomes sequentially located opposite to the first charging device 152, the static elimination device 154, the second charging device 153, the light exposure device 155, the development device 156, the transfer roller 157, and the cleaning device 158. Through the above, a supplementary charging process of the first charging device 152, a static elimination process of the static elimination device 154, a main charging process of the second charging device 153, a light exposure process of the light exposure device 155, a development process of the development device 156, a transfer process of the transfer roller 157, and a cleaning process of the cleaning device 158 are performed on the given region of the image bearing surface 1511 in the stated order.

The first charging device 152 performs a supplementary charging process. In the supplementary charging process, the first charging device 152 receives a first charging bias and charges an opposite region to positive polarity. The first charging bias has the first polarity (positive polarity). The opposite region for the first charging device 152 is a region of the image bearing surface 1511 after transfer and cleaning. In other words, the opposite region is a region on which a transfer process and a cleaning process have been performed prior to the region becoming located opposite to the first charging device 152. In the present embodiment, the first charging bias is a direct current bias.

As explained further below, during the transfer process a transfer bias is supplied to the transfer roller 157, which is pressed against the photosensitive drum 151. The transfer bias has a second polarity (negative polarity in the present embodiment) of opposite polarity to the first polarity. As a result of the transfer bias, a section of the image bearing surface 1511 may be charged to negative polarity. The first charging device 152 charges the entirety of the opposite region to positive polarity. The entirety of the opposite region includes the section charged to negative polarity.

The first charging device 152 includes a first charging roller 1521. The first charging roller 1521 is supported in a rotatable manner by a housing of the first charging device 152. An outer circumferential surface of the first charging roller 1521 is for example formed from a rubber material. The first charging roller 1521 is in contact with the image bearing surface 1511. As a result, the first charging roller 1521 is rotationally driven by the photosensitive drum 151. By supplying the first charging bias to the first charging roller 1521, the first charging bias is applied to the opposite region for the first charging device 152. As a result, the opposite region for the first charging device 152 is charged.

The static elimination device 154 performs a static elimination process. In the static elimination process, the static elimination device 154 eliminates electrical charge (positive electrical charge in the present embodiment) from an opposite region by irradiating the opposite region with static elimination light. The opposite region for the static elimination device 154 is a region of the image bearing surface 1511 that has been charged by the first charging device 152. In other words, the opposite region is a region on which the supplementary charging process has been performed prior to the region becoming located opposite to the static elimination device 154. The static elimination device 154 performs the static elimination process in order to eliminate positive electrical charge from the opposite region that has been charged to positive polarity through the supplementary charging process. As a result of the static elimination process, the electrical potential of the opposite region is reduced to a positive initial electrical potential or to 0 V. Through the above, the opposite region for the static elimination device 154 is uniformly charged to the positive initial electrical potential or has electrical charge clearly eliminated therefrom.

The second charging device 153 performs a main charging process. In the main charging process, the second charging device 153 receives a second charging bias and uniformly charges an opposite region to a specific electrical potential of positive polarity. The second charging bias has the first polarity (positive polarity). The opposite region for the second charging device 153 is a region of the image bearing surface 1511 from which static has been eliminated by the static elimination device 154. In other words, the opposite region is a region on which the static elimination process has been performed prior to the region becoming located opposite to the second charging device 153. In the present embodiment, the second charging bias is a direct current bias.

The second charging device 153 includes a second charging roller 1531. The second charging roller 1531 is supported in a rotatable manner by a housing of the second charging device 153. An outer circumferential surface of the second charging roller 1531 is for example formed from a rubber material. The second charging roller 1531 is in contact with the image bearing surface 1511. As a result, the second charging roller 1531 is rotationally driven by the photosensitive drum 151. By supplying the second charging bias to the second charging roller 1531, the second charging bias is applied to the opposite region for the second charging device 153. As a result, the opposite region for the second charging device 153 is charged.

The light exposure device 155 performs a light exposure process. In the light exposure process, the light exposure device 155 outputs laser light based on image data and exposes an opposite region to the laser light. The opposite region for the light exposure device 155 is a region of the image bearing surface 1511 that has been charged by the second charging device 153. In other words, the opposite region is a region on which the main charging process has been performed prior to the region becoming located opposite to the light exposure device 155. The light exposure process is performed with respect to the entirety of a process target region of the image bearing surface 1511. As a result of the light exposure process, an electrostatic latent image corresponding to the image data is formed in the process target region. The term process target region refers to a region of the image bearing surface 1511 that is used to form an image indicated by the image data on a sheet of paper P.

The development device 156 performs a development process. In the development process, the development device 156 develops an electrostatic latent image in an opposite region using toner. The toner is charged to the first polarity (positive polarity). The opposite region for the development device 156 is a region on which the light exposure process has been performed prior to the region becoming located opposite to the development device 156. The development process is performed with respect to the entirety of the process target region. As a result of the development process, a toner image corresponding to the image data is formed in the process target region. In the present embodiment, the image forming apparatus 100 performs development by reversal development. In other words, the development device 156 supplies toner onto a charge elimination section of the image bearing surface 1511. The toner is charged to the same polarity (positive polarity in the present embodiment) as the image bearing surface 1511. The charge elimination section is a section from which electrical charge has been eliminated through the light exposure process. As a result, a toner image is formed on the image bearing surface 1511.

The development device 156 includes a development roller 1561 and a toner supply roller 1562. The development roller 1561 and the toner supply roller 1562 are each supported in a rotatable manner by a housing of the development device 156. The toner supply roller 1562 is located opposite to the development roller 1561 with a gap of a specific size therebetween. A first development bias is supplied to the toner supply roller 1562. As a result of the first development bias, charged toner detaches from the toner supply roller 1562 and is supplied to the development roller 1561. The development roller 1561 is located opposite to the photosensitive drum 151 with a gap of a specific size therebetween. A second development bias is supplied to the development roller 1561. As a result of the second development bias, charged toner detaches from the development roller 1561 and is supplied onto the image bearing surface 1511 to develop the electrostatic latent image.

The transfer roller 157 is a transfer device. The transfer device forms a nip 1571 in conjunction with the photosensitive drum 151. The nip 1571 is a nip for a sheet of paper P. The transfer device receives a transfer bias and transfers a toner image onto the paper P from the image bearing surface 1511 as the paper P passes through the nip 1571. The transfer bias has the second polarity (negative polarity). The transfer roller 157 is pressed against the photosensitive drum 151. As a result, the nip 1571 is formed between the transfer roller 157 and an opposite region for the transfer roller 157. In the present embodiment, the transfer bias is a direct current bias.

The transfer roller 157 performs a transfer process. In the transfer process, the transfer roller 157 transfers the toner image onto the paper P from the opposite region. The opposite region for the transfer roller 157 is a region on which the development process has been performed prior to the region becoming located opposite to the transfer roller 157. The transfer process is performed with respect to the entirety of the process target region. As a result of the transfer process, the toner image corresponding to the image data is transferred onto the paper P. The transfer bias of negative polarity is supplied to the transfer roller 157 while the paper P is passing through the nip 1571 and also for a specific period of time before and after the paper P passes through the nip 1571.

The cleaning device 158 performs a cleaning process. In the cleaning process, the cleaning device 158 removes residual toner remaining on an opposite region. The opposite region for the cleaning device 158 is a region on which the transfer process has been performed prior to the region becoming located opposite to the cleaning device 158.

The cleaning device 158 includes a cleaning blade 1581, a sweeping roller 1582, and a toner container 1583. The cleaning blade 1581 is for example a plate shaped member that is formed from a rubber material. A tip of the cleaning blade 1581 is in contact with the image bearing surface 1511. Through the above configuration, the cleaning blade 1581 collects toner remaining on the image bearing surface 1511. The sweeping roller 1582 conveys toner that has been collected by the cleaning blade 1581 to the toner container 1583.

An arrow 150 in FIG. 2 indicates a conveyance path of paper P in the image forming section 15 (referred to below simply as a conveyance path). A conveyance direction of paper P along the conveyance path 150 is the same as the direction of the arrow. In other words, the conveyance direction is a direction toward the nip 1571 from the registration roller pair 14. The trailing end detection switch 159 is located at a specific position along the conveyance path 150. More specifically, the trailing end detection switch 159 is located upstream of the nip 1571 along the conveyance path 150.

The trailing end detection switch 159 detects a trailing end of a sheet of paper P at a trailing end detection position either as the paper P is passing through the nip 1571 or prior to the paper P passing through the nip 1571. The term trailing end detection position refers to a position at which the trailing end detection switch 159 is located. Furthermore, the registration roller pair 14 detects a leading end of a sheet of paper P at a leading end detection position prior to the paper P passing through the nip 1571. The term leading end detection position refers to a position at which the registration roller pair 14 is located.

Figure 3:
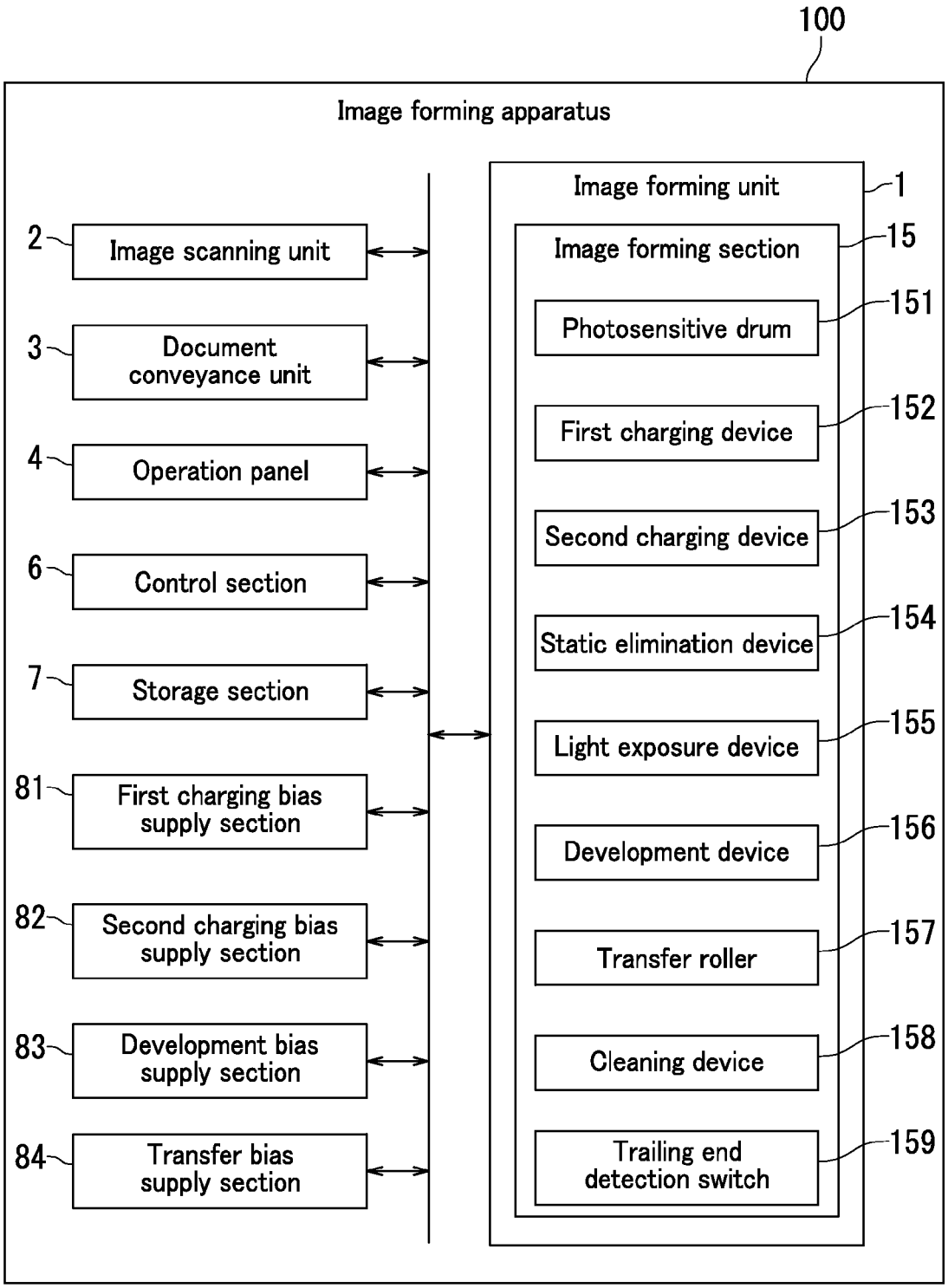
FIG. 3 is a block diagram of an example of an image forming apparatus according to an embodiment.

FIG. 3 is a block diagram of the image forming apparatus according to the embodiment.

As illustrated in FIG. 3, the image forming apparatus 100 includes the image forming unit 1, the image scanning unit 2, the document conveyance device 3, and the operation panel 4. The image forming apparatus 100 further includes a control section 6, a storage section 7, a first charging bias supply section 81 (supply section), a second charging bias supply section 82, a development bias supply section 83, and a transfer bias supply section 84. The image forming unit 1, the image scanning unit 2, the document conveyance device 3, the operation panel 4, the storage section 7, the first charging bias supply section 81, the second charging bias supply section 82, the development bias supply section 83, and the transfer bias supply section 84 are communicatively connected to the control section 6.

The first charging bias supply section 81 supplies the first charging bias to the first charging device 152 under the control of the control section 6. The second charging bias supply section 82 supplies the second charging bias to the second charging device 153 under the control of the control section 6. The development bias supply section 83 supplies a development bias (first development bias and second development bias) to the development device 156 under the control of the control section 6. The transfer bias supply section 84 supplies the transfer bias to the transfer roller 157 under the control of the control section 6.

The storage section 7 includes read only memory (ROM), random access memory (RAM), and a secondary storage device. The secondary storage device is for example a non-volatile storage device such as a hard disk or flash memory. The ROM of the storage section 7 stores various computer programs that are executed by the control section 6. The control section 6 executes the various computer programs while they are loaded into the RAM from the ROM. Functions of the control section 6 are implemented as a result of execution of the aforementioned computer programs.

The control section 6 controls operation of the image forming apparatus 100. For example, the control section 6 controls the image forming unit 1. As a result, the control section 6 causes the image forming unit 1 to form an image. While causing the image forming unit 1 to form an image, the control section 6 also controls the magnitudes of the first charging bias, the second charging bias, the development bias, and the transfer bias that are respectively supplied from the first charging bias supply section 81, the second charging bias supply section 82, the development bias supply section 83, and the transfer bias supply section 84.

Figure 5A:
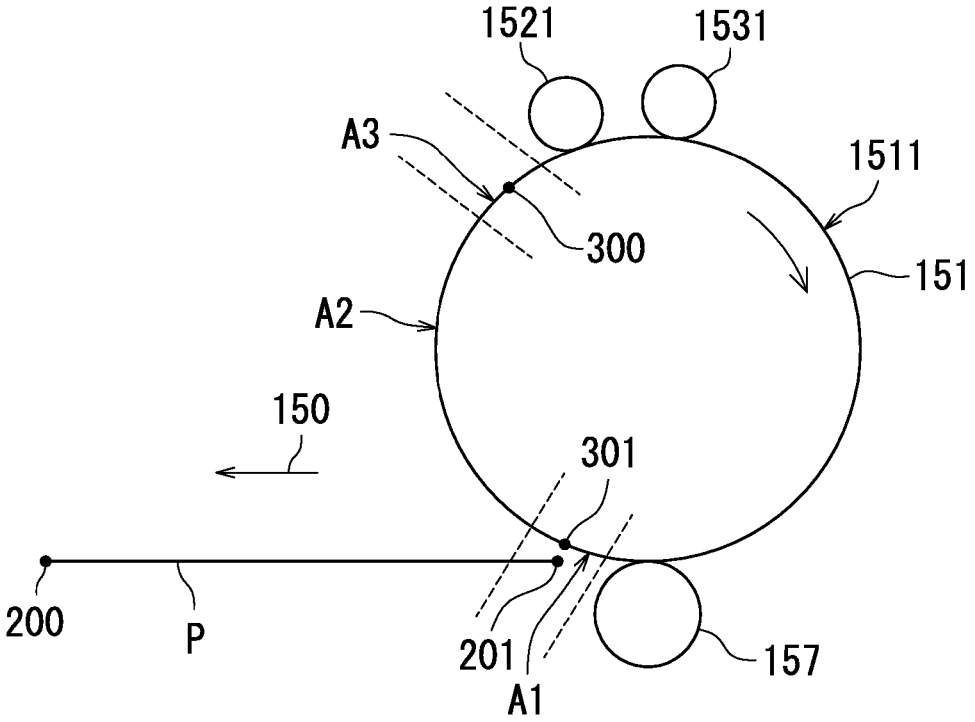
FIG. 5A is diagram illustrating a first region, a second region, and a third region.

The following describes more specifically how the control section 6 controls magnitude of the first charging bias. The control section 6 performs control such that a trailing end bias value (first value) is greater than a standard charging bias value (second value). The trailing end bias value is the absolute value of the first charging bias during charging of a trailing end contact region A1 (first region) of the image bearing surface 1511. The standard charging bias value is the absolute value of the first charging bias during charging of a trailing end non-contact region A2 (second region) of the image bearing surface 1511. The term trailing end contact region A1 refers to a section 301 (trailing end contact section) of the image bearing surface 1511 that has come into contact with a trailing end 201 of a sheet of paper P in terms of the conveyance direction as illustrated in FIG. 5A. In other words, the trailing end contact region A1 includes a section 301 that may be charged to a relatively large electrical potential of negative polarity. On the other hand, the term trailing end non-contact region A2 refers to a region that does not include a section 300 of the image bearing surface 1511 that has come into contact with a leading end 200 or a section 301 of the image bearing surface 1511 that has come into contact with a trailing end 201 of a sheet of paper P in terms of the conveyance direction.

The standard charging bias value is set as a value that enables charging of the entirety of the trailing end non-contact region A2 to positive polarity. Note that it is not necessary to set the standard charging bias value as a particularly large value because the trailing end non-contact region A2 does not include the trailing end contact section 301. On the other hand, the trailing end bias value is set as a value that enables charging of the entirety of the trailing end contact region A1 to positive polarity. The trailing end bias value ensures that the trailing end contact section 301, which may be charged to a relatively large electrical potential of negative polarity, is charged to positive polarity. Therefore, the trailing end bias value is set as a relatively large value. The control section 6 may for example set the trailing end bias value based on a value of the transfer bias. More specifically, the control section 6 estimates the electrical potential of the trailing end contact section 301 after undergoing a transfer process based on the value of the transfer bias. Based on the estimated value, the control section 6 may set the trailing end bias value as a value that is as small as possible while also enabling charging of the trailing end contact section 301 to positive polarity.

Figure 5B:
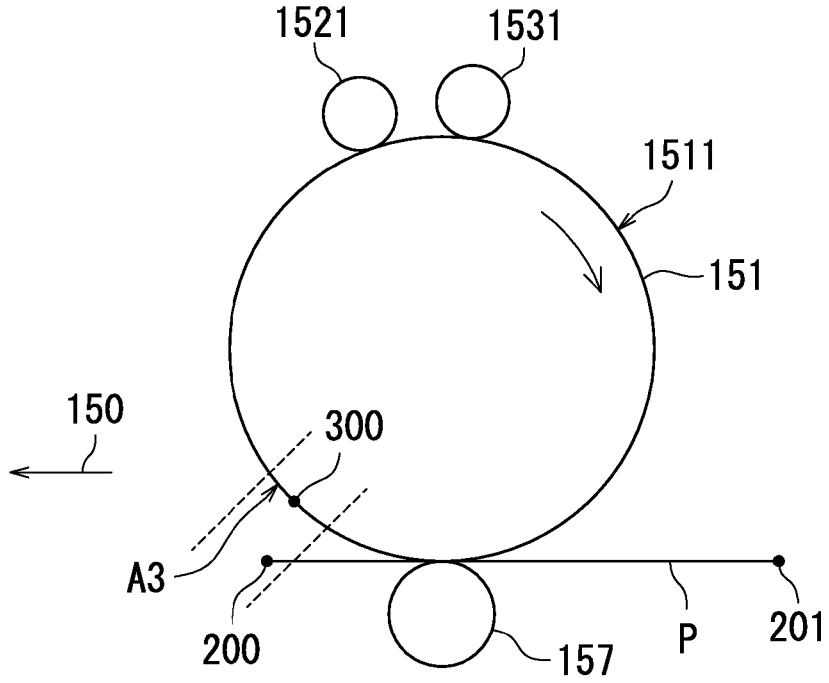
FIG. 5B is a diagram illustrating the third region.

In addition to performing control such that the trailing end bias value is greater than the standard charging bias value, the control section 6 may also perform control such that a leading end bias value (third value) is greater than the standard charging bias value. The leading end bias value is an absolute value of the first charging bias during charging of a leading end contact region A3 (third region) of the image bearing surface 1511. The term leading end contact region A3 refers to a region that includes a leading end contact section 300 as illustrated in FIG. 5B. The leading end contact section 300 is a section of the image bearing surface 1511 that has come into contact with a leading end 200 of a sheet of paper P in terms of the conveyance direction. The leading end bias value is set as a value that enables charging of the entirety of the leading end contact region A3 to positive polarity. In the present embodiment, the leading end bias value is set as the same value as the trailing end bias value.

The following explains, with reference to FIG. 4, FIG. 5A, and FIG. 5B, transition of the absolute value of the first charging bias (referred to below as a first charging bias value), the absolute value of the second charging bias (referred to below as a second charging bias value), and the absolute value of the transfer bias (referred to below as a transfer bias value) based on control by the control section 6.

Figure 4:
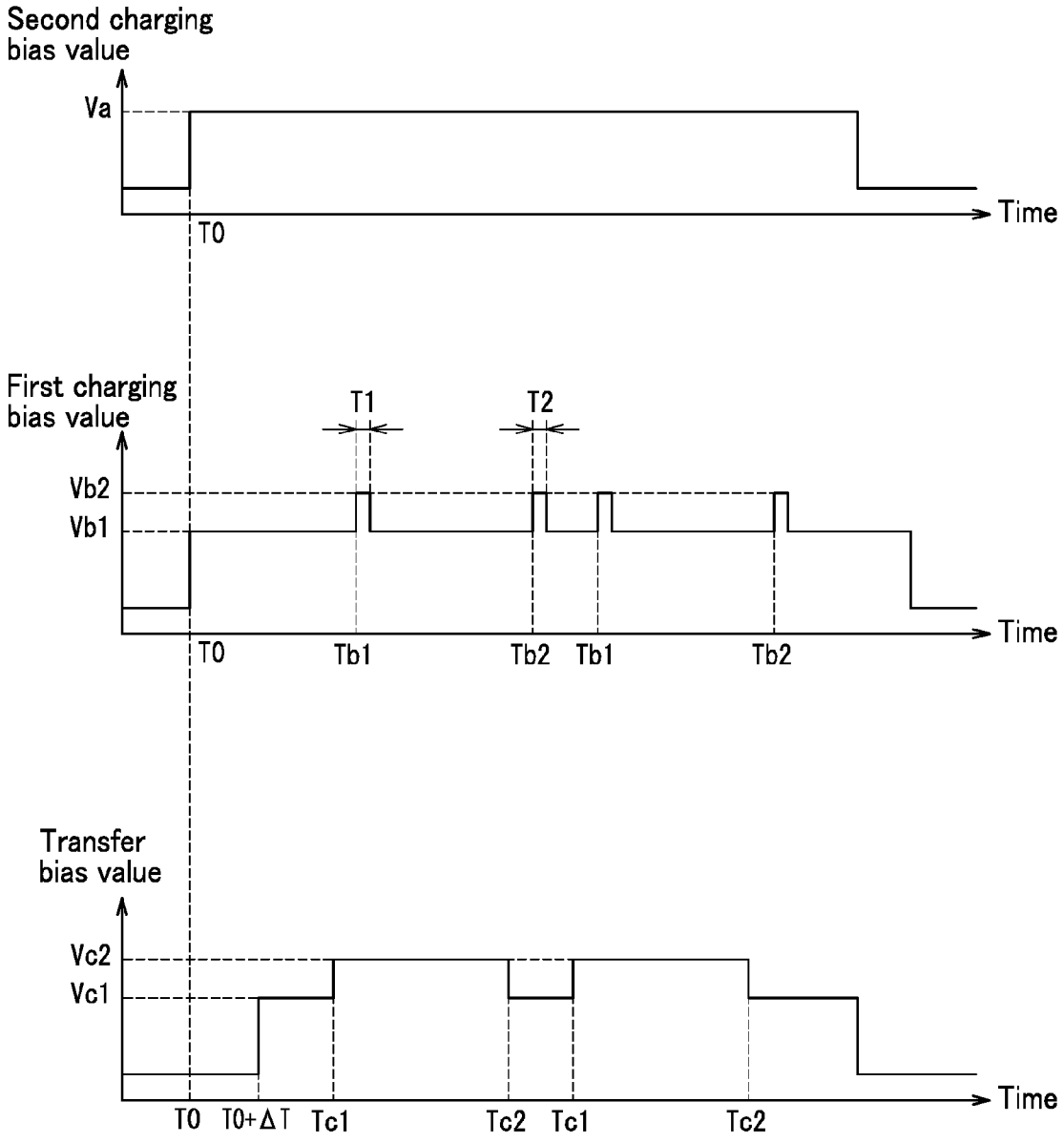
FIG. 4 is a time chart illustrating transition of a first charging bias value, a second charging bias value, and a transfer bias value.

FIG. 4 is a time sheet illustrating transition of the first charging bias value, the second charging bias value, and the transfer bias value.

The following first explains transition of the second charging bias value. Supply of the second charging bias to the second charging device 153 starts at time T0 at which an image formation process starts. The second charging bias value is maintained at a constant value Va while the second charging bias is being supplied. The second charging bias value Va is for example set based on an installation environment of the image forming apparatus 100 or a number of sheets of paper P on which images are to be formed.

The following explains transition of the transfer bias value. Supply of the transfer bias to the transfer roller 157 starts once a specific period of time ΔT has elapsed since the image formation process started at time T0. The transfer bias value is set as a specific standard value Vc1 when supply of the transfer bias starts. The standard value Vc1 for the transfer bias value is for example set based on the installation environment of the image forming apparatus 100 or the number of sheets of paper P on which images are to be formed.

Next, the transfer bias value is raised to a value Vc2 that is greater than the standard value Vc1 at time Tc1 at which a leading end of a sheet of paper P in terms of the conveyance direction passes through the nip 1571. Next, the transfer bias value is lowered to the standard value Vc1 at time Tc2 at which a trailing end of the sheet of paper P in terms of the conveyance direction passes through nip 1571. In other words, the transfer bias value is set as the value Vc2 that is greater than the standard value Vc1 while the paper P is passing through the nip 1571.

The following explains transition of the first charging bias value. Supply of the first charging bias to the first charging device 152 starts at time T0 at which the image formation process starts. The first charging bias value is set as a standard charging bias value Vb1 when supply of the first charging bias starts. The standard charging bias value Vb1 is for example set based on an installation environment of the image forming apparatus 100 or a number of sheets of paper P on which images are to be formed.

Next, the first charging bias value is raised to a leading end bias value Vb2 (the same value as the trailing end bias value in the present embodiment) that is greater than the standard charging bias value Vb1 at time Tb1. Once a specific first period of time T1 has elapsed after time Tb1, the first charging bias value is lowered to the standard charging bias value Vb1.

Time Tb1 corresponds to a time at which the first charging device 152 starts charging the leading end contact region A3. In other words, time Tb1 corresponds to a time at which at least part of the leading end contact region A3 is included in the opposite region for the first charging device 152. The control section 6 may for example calculate time Tb1 based on a diameter and rotational speed of the photosensitive drum 151, a position of the first charging device 152, a distance between the nip 1571 and the leading end detection position, a time at which a leading end of a sheet of paper P in terms of the conveyance direction is detected at the leading end detection position, and a conveyance speed of the paper P. The first period of time T1 corresponds to the amount of time required for the first charging device 152 to charge the leading end contact region A3. In other words, the first period of time T1 corresponds to a period of time during which at least part of the leading end contact region A3 is included in the opposite region for the first charging device 152.

As described above, in the present embodiment the first charging bias value is set as the leading end bias value Vb2 that is greater than the standard charging bias value Vb1 while the first charging device 152 is charging the leading end contact region A3.

After being lowered to the standard charging bias value Vb1, the first charging bias value is raised to a trailing end bias value Vb2 that is greater than the standard charging bias value Vb1 at time Tb2. Once a specific second period of time T2 has elapsed after time Tb2, the first charging bias value is lowered to the standard charging bias value Vb1.

Time Tb2 corresponds to a time at which the first charging device 152 starts charging the trailing end contact region A1. In other words, time Tb2 corresponds to a time at which at least part of the trailing end contact region A1 is included in the opposite region for the first charging device 152. The control section 6 may for example calculate time Tb2 based on the diameter and rotational speed of the photosensitive drum 151, the position of the first charging device 152, a distance between the nip 1571 and the trailing end detection position, a time at which a trailing end of the sheet of paper P in terms of the conveyance direction is detected at the trailing end detection position, and the conveyance speed of the paper P. The second period of time T2 corresponds to the amount of time required for the first charging device 152 to charge the trailing end contact region A1. In other words, the second period of time T2 corresponds to a period during which at least part of the trailing end contact region A1 is included in the opposite region for the first charging device 152.

As described above, in the present embodiment the first charging bias value is set as the trailing end bias value Vb2 that is greater than the standard charging bias value Vb1 while the first charging device 152 charges the trailing end contact region A1.

According to the present embodiment, the first charging bias value is set as the standard charging bias value Vb1 while the first charging device 152 charges the trailing end non-contact region A2—in other words, during normal charging—and is temporarily set as the trailing end bias value Vb2 that is greater than the standard charging bias value Vb1 while the first charging device 152 charges the trailing end contact region A1. Furthermore, the first charging bias value is temporarily set as the leading end bias value Vb2 (the same value as the trailing end bias value in the present embodiment) that is greater than the standard charging bias value Vb1 while the first charging device 152 charges the leading end contact region A3. Note that the standard charging bias value Vb1 is a value that enables charging of the entirety of the trailing end non-contact region A2 to positive polarity and does not need to be set as a particularly large value. On the other hand, the trailing end bias value Vb2 is a value that enables charging of the entirety of the trailing end contact region A1 to positive polarity and is set as a relatively large value. Furthermore, the leading end bias value Vb2 is a value that enables charging of the entirety of the leading end contact region A3 to positive polarity.

As a result of the configuration described above, the first charging device 152 can charge the entirety of the opposite region to positive polarity regardless of whether the opposite region is the trailing end non-contact region A2, the trailing end contact region A1, or the leading end contact region A3. Furthermore, the first charging bias value is normally set as the standard charging bias value which is not particularly large and is only temporarily set as the relatively large trailing end bias value or leading end bias value. As a consequence, deterioration of the photosensitive drum 151 can be inhibited. Deterioration of the photosensitive drum 151 occurs if a large first charging bias is supplied to the first charging device 152 at all times. Therefore, the image forming apparatus 100 according to the present embodiment can inhibit occurrence of image defects while also inhibiting shortening of the lifetime of the photosensitive drum 151. The aforementioned image defects are caused by the transfer bias.

Through the above, an embodiment of the present disclosure has been explained. However, the present disclosure is not limited to the embodiment and various alterations may be made without deviating from the intended scope of the present disclosure.

For example, in the present embodiment the first charging bias value is set as the value Vb2 (trailing end bias value or leading end bias value) that is greater than the standard charging bias value Vb1 while the first charging device 152 charges the trailing end contact region A1 or the leading end contact region A3, but alternatively the first charging bias value may be set as described below. The first charging bias value may be set as the trailing end bias value Vb2 that is greater than the standard charging bias value Vb1 while the first charging device 152 charges the trailing end contact region A1, but may be maintained as the standard charging bias value Vb1 while the first charging device 152 charges the leading end contact region A3.

Also, although in the present embodiment the first charging device 152, the static elimination device 154, the second charging device 153, the light exposure device 155, the development device 156, the transfer roller 157, and the cleaning device 158 are explained as being arranged in the stated order in the rotation direction of the photosensitive drum 151, the aforementioned arrangement is not a limitation. In other words, although the first charging device 152 is located downstream of the cleaning device 158 and upstream of the static elimination device 154 in terms of the rotation direction of the photosensitive drum 151 in the present embodiment, the first charging device 152 may for example be located downstream of the transfer roller 157 and upstream of the cleaning device 158 in terms of the rotation direction of the photosensitive drum 151.

In another alternative example, a device that performs both the supplementary charging process and the cleaning process may be included instead of the first charging device 152 and the cleaning device 158 at a location downstream of the transfer roller 157 and upstream of the static elimination device 154 in terms of the rotation direction of the photosensitive drum 151.

What is claimed is:

1. An image forming apparatus comprising:

an image bearing member configured to bear a developer image formed using a developer charged to a first polarity;

a transfer device configured to form a nip in conjunction with the image bearing member and to transfer the developer image onto a recording medium from the image bearing member, as the recording member passes through the nip, by receiving a transfer bias of a second polarity opposite to the first polarity;

a first charging device configured to charge a region of the image bearing member that has undergone transfer by the transfer device to the first polarity by receiving a first charging bias of the first polarity;

a static elimination device configured to eliminate static from the region of the image bearing member that has been charged by the first charging device;

a second charging device configured to charge the region of the image bearing member from which static has been eliminated by the elimination device to a specific electrical potential of the first polarity by receiving a second charging bias of the first polarity;

a light exposure device configured to form an electrostatic latent image on the image bearing member by exposing the region that has been charged by the second charging device to light; and a development device configured to form the developer image on the image bearing member by developing the electrostatic latent image using the developer, wherein an absolute value of the first charging bias is set as a first value during charging of a first region of the image bearing member that has undergone transfer by the transfer device, the absolute value of the first charging bias is set as a second value during charging of a second region of the image bearing member that has undergone transfer by the transfer device, the absolute value of the first charging bias is set as a third value during charging of a third region of the image bearing member that has undergone transfer by the transfer device, each of the first value and the third value is greater than the second value, the first region includes a section that has come into contact with a trailing end of the recording medium in terms of a conveyance direction thereof, the second region does not include the section that has come into contact with the trailing end or a section that has come into contact with a leading end of the recording medium in terms of the conveyance direction, the third region includes the section that has come into contact with the leading end of the recording medium in terms of the conveyance direction, the absolute value of the first charging bias is temporarily set as the third value for a first period of time during which the first charging device charges the third region, the absolute value of the first charging bias is temporarily set as the first value for a second period of time during which the first charging device charges the first region, and the absolute value of the first charging bias is set as the second value for a third period of time during which the first charging device charges the second region.

2. The image forming apparatus according to claim 1, wherein the first value is a value that enables charging of the entirety of the first region to the first polarity, and the second value is a value that enables charging of the entirety of the second region to the first polarity.

3. The image forming apparatus according to claim 1, further comprising:

a supply section configured to supply the first charging bias to the first charging device; and a control section configured to set a value of the first charging bias supplied by the supply section, wherein the control section sets the first value based on a value of the transfer bias.

4. The image forming apparatus according to claim 1, wherein the first charging device includes a charging roller configured to rotate in contact with an image bearing surface of the image bearing member that bears the developer image, and the image bearing surface is charged through the charging roller receiving the first charging bias.

5. The image forming apparatus according to claim 1, wherein an image bearing surface of the image bearing member that bears the developer image is formed by an organic photosensitive member.

6. The image forming apparatus according to claim 1, wherein the third value is a value that enables charging of the entirety of the third region to the first polarity.

* * * * *